United States Patent [19]

Taniwaki

[11] 4,170,848

[45] Oct. 16, 1979

[54] SLIDING DOOR

[75] Inventor: Genshi Taniwaki, Kumamoto, Japan

[73] Assignee: Kongo Co., Ltd., Kumamoto, Japan

[21] Appl. No.: 894,708

[22] Filed: Apr. 10, 1978

Related U.S. Application Data

[62] Division of Ser. No. 802,445, Jun. 1, 1977.

[30] Foreign Application Priority Data

| | | | |
|---|---|---|---|
| Jun. 2, 1976 | [JP] | Japan | 51-71245[U] |
| Jun. 2, 1976 | [JP] | Japan | 51-71246[U] |
| Jun. 15, 1976 | [JP] | Japan | 51-77928[U] |

[51] Int. Cl.[2] ..... E05F 11/00; E05D 13/04

[52] U.S. Cl. ..... 49/358; 49/360; 49/449; 109/73; 292/112; 292/199

[58] Field of Search ..... 49/360, 358, 361, 362, 49/372, 324, 449; 109/73, 59, 77; 292/112, 199, 333

[56] References Cited

U.S. PATENT DOCUMENTS

| | | | |
|---|---|---|---|
| 1,083,438 | 1/1914 | Dohse | 292/112 X |
| 1,090,305 | 3/1914 | Hoffman | 292/333 X |
| 1,210,103 | 12/1916 | Ritter | 49/358 |
| 1,646,181 | 10/1927 | Babekuhl | 292/199 X |
| 1,816,134 | 7/1931 | Wood | 292/333 |
| 2,488,063 | 11/1949 | Massie | 49/372 X |
| 2,714,472 | 8/1955 | Richardson | 49/362 X |

*Primary Examiner*—Philip C. Kannan

*Attorney, Agent, or Firm*—Armstrong, Nikaido, Marmelstein & Kubovcik

[57] ABSTRACT

A sliding door is provided which is suitable for use as a heavy door for vaults in banks. The door is provided at its bottom with driving wheels adapted to be rotated manually by means of a handle, through a suitable power transmitting means, thereby to move the door along a rail. The power transmitting means may incorporate a suitable reduction means so that the door may be moved with a reduced force and, accordingly, at a lower speed. Means are provided for locking the door in the closed state.

7 Claims, 24 Drawing Figures

FIG. 12
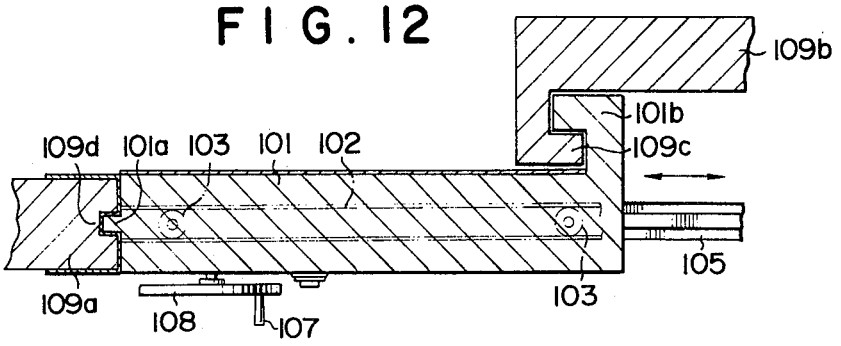
FIG. 13
FIG. 14
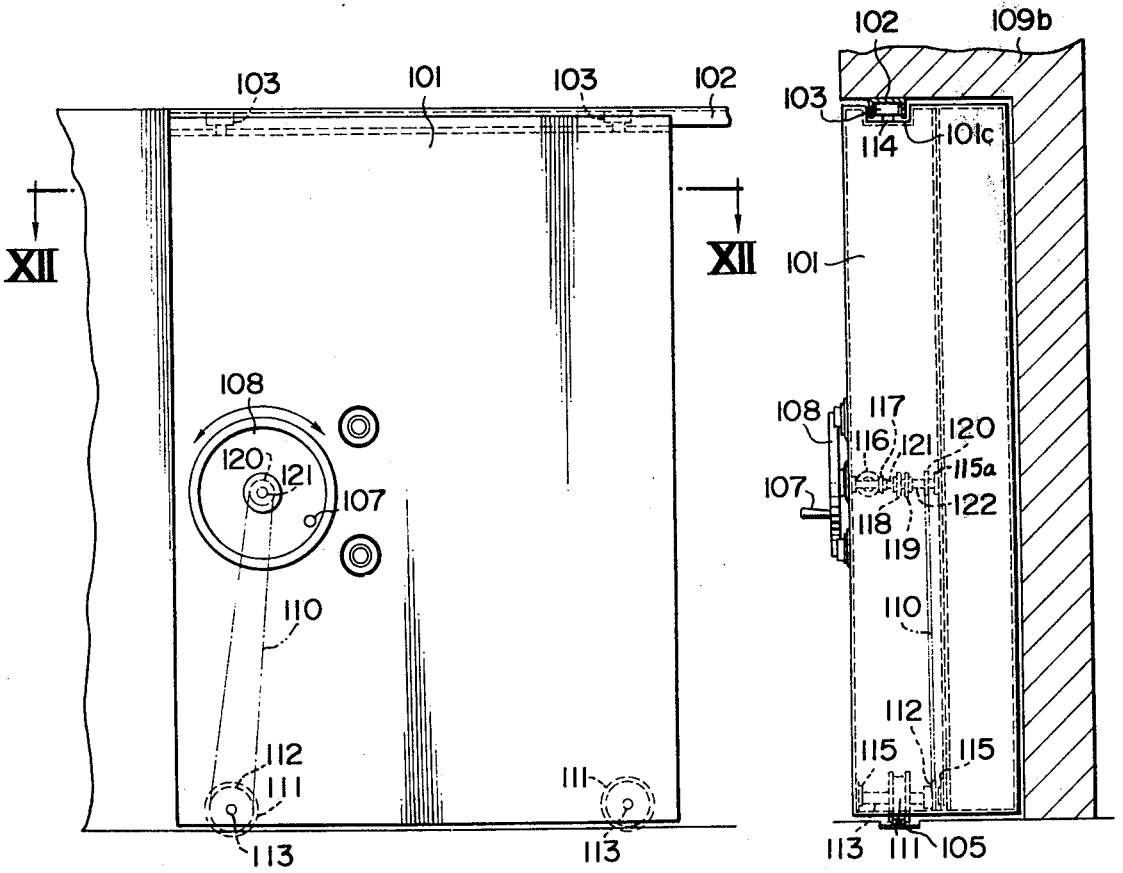

SLIDING DOOR

This is a division, of application Ser. No. 802,445, filed June 1, 1977.

BACKGROUND OF THE INVENTION

The present invention relates to sliding doors and, more particularly, to heavy sliding doors such as those for vaults installed in banks.

Conventionally, most of such heavy doors as those for vaults of banks have been constructed as hinged doors having one or two door bodies adapted to be swung around the hinges when opened.

These hinged doors have fundamental drawbacks as listed below.

(1) A semicircular space centered at the hinge and of a radius equal to the length of the door body must be preserved.

(2) A considerable manual force is required for opening and closing, when the door has been finished with a deteriorated precision.

(3) A high precision is required for the installation of the door. If the door is not attached accurately, e.g. inclined forwardly, the door tends to open by itself, once opened slightly, causing a substantial danger for the operator.

(4) In view of its purpose to express the safety of deposits and the reliability of the bank to the clients, the door of the vault is usually installed at a position easily seen by the clients. However, only the back side of the door is visible to the clients during the use of the vault, in the case of the hinged doors, which presents a poor appearance and, therefore, has less of a propaganda effect for the safety of the bank.

(5) A complicated stepped structure is necessary at the contact area of the door with the wall of vault, for preventing fire and smoke from invading the vault.

(6) The higher precision of construction and installation lead to a correspondingly higher cost of manufacture and installation.

SUMMARY OF THE INVENTION

It is therefore an object of the invention to overcome aforementioned drawbacks of the prior art by providing an improved door structure.

According to the invention, there is provided a door adapted to be moved on a rail laid along a wall thereby to close an opening formed in the wall comprising, a door body having a plurality of pairs of wheels, each one of said pairs having a connecting axle, a first manually rotatable member with a shaft rotatably attached to one side of the door, a rotary driving member of a predetermined diameter coaxially carried by said shaft, a rotary driven member carried by one of said axles and having a diameter larger than that of said driving member, an endless power transmission member connected between said driving and driven members, a second manually rotatable member with a shaft rotatably attached to said one side of said door, a key member having a shaft arranged to transmit the movement of said shaft of said first manually rotatable member, said key member locking said door body in the closed position when said second manually rotatable member is operated, and key locking means having engagement means and detecting means partially extending out of the side end of the door and positioned for detecting a wall contact, said engagement means positively locking said second manually rotatable member in a fixed condition when said detecting means are not actuated.

The above and other objects, as well as advantageous features of the invention will become clear from the following description of preferred embodiments taken in conjunction with the attached drawings in which:

BRIEF DESCRIPTION OF THE DRAWINGS

FIG. 12 is a sectional view taken along the line XII—XII of FIG. 14 illustrating a handle mechanism incorporated in the sliding door embodying the invention, FIG. 13 is a right side elevational view of the door of FIG. 14, FIG. 14 is a front elevational view of the door.

DESCRIPTION OF THE PREFERRED EMBODIMENTS

Figure 1:
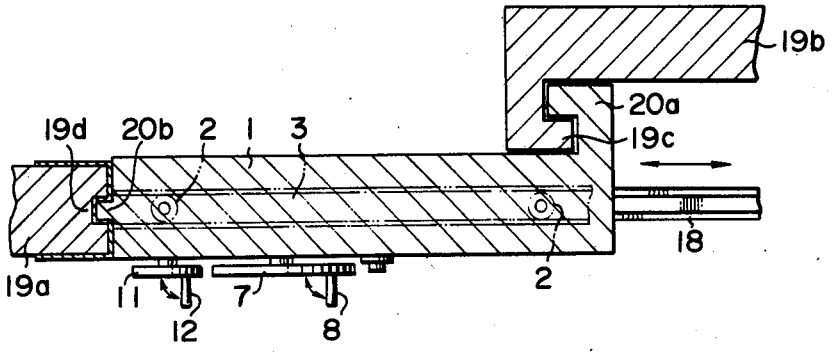
FIG. 1 is a sectional view of a sliding door in accordance with the invention, taken along the line I—I of FIG. 3.
Figure 3:
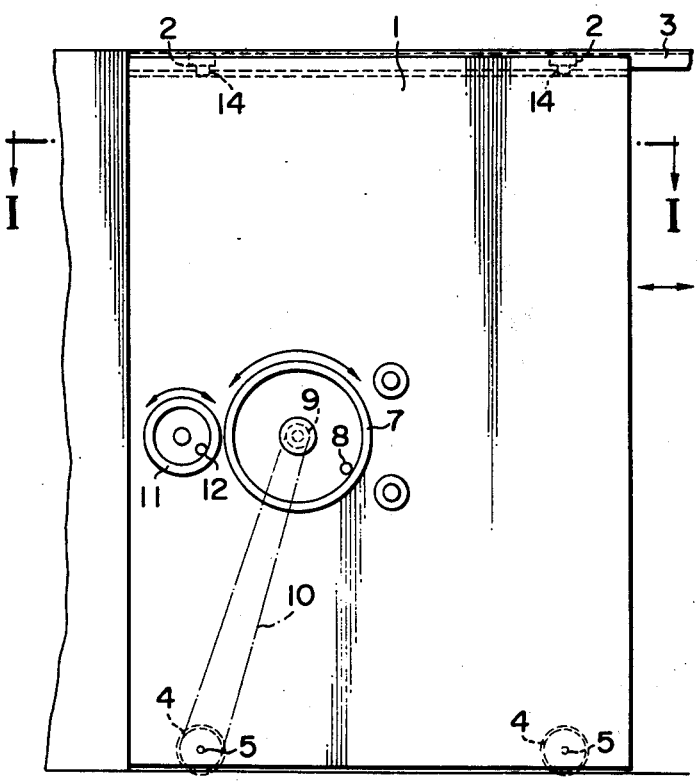
FIG. 3 shows a front elevation.
Figure 2:
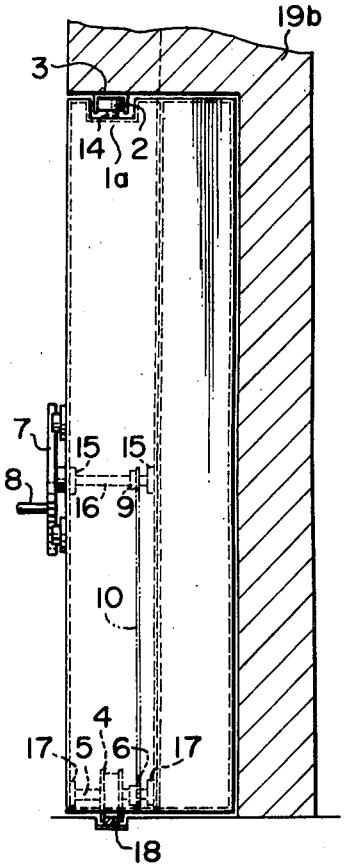
FIG. 2 is an elevational view of the right-hand side of the door of FIG. 3.

Referring at first to FIGS. 1 to 3, a door 1 is positioned at an entrance for a vault, which opens between a flat vault wall 19*a* and a hook-shaped vault wall *19b*. Beneath the door 1, is a lower rail 18 laid from one end of the flat wall 19*a* along the extension of the later. Wheels 4 which roll on the rail 18 are secured to the bottom of the door through axles 5. Guide rollers 2 are rotatably secured, through guide roller shafts 14, to the recessed portion 1*a* of the upper surface of the door 1. These guide rollers are positioned within an upper guide rail 3 provided on the ceiling of the entrance, with a slight gap between themselves and the walls of the guide rail, so as to assist to smoothen the movement of the door 1 when the later is opened or closed. A projection or protrusion 20*b* is formed at one side surface of the door 1 for contacting the flat wall 19*a* of the vault, while the other side surface of the door constitutes a hook-shaped engaging portion 20*a*. The projection 20*b* is adapted to be fitted into a recess of a groove 19*d* of the flat wall 19*a*, when the door is closed. The engaging portion 20*a* of the door 1 is adapted to engage an engaging portion 19*c* on the hook-shaped wall 19*b*.

A driving handle 7 is secured to the surface of the door through a shaft. The handle 7 has on its periphery a grip 8 which can be turned up and down in the direction of the arrow shown in FIG. 1.

The surface of the door also carries a locking handle 11 which is coupled to the door through a shaft. The locking handle 11 also has a grip 12 which can be turned up and down in the direction of the arrow in FIG. 1. A handle shaft 16 to which the driving handle 7 is fixed has both ends rotatably supported by reinforcing members disposed in the front and the rear panel of the door 1, through respective bearings 15. Between a handle shaft sprocket 9 on the handle shaft 16 and a sprocket 6 coaxially fixed to the wheel axle 5, there is provided suitable power transmitting means 10 which may be an endless chain, rope, belt or the like going round those sprockets. The arrangement is such that the rotary motion of the driving handle in the direction of the arrow in FIG. 3 is transmitted to the wheel 4, through the handle shaft 16, handle shaft sprocket 9, power transmitting means 10, sprocket 6 and the axle 5 of the wheel, to thereby move the door 1 right and leftward, as viewed in FIG. 3.

Figure 4:
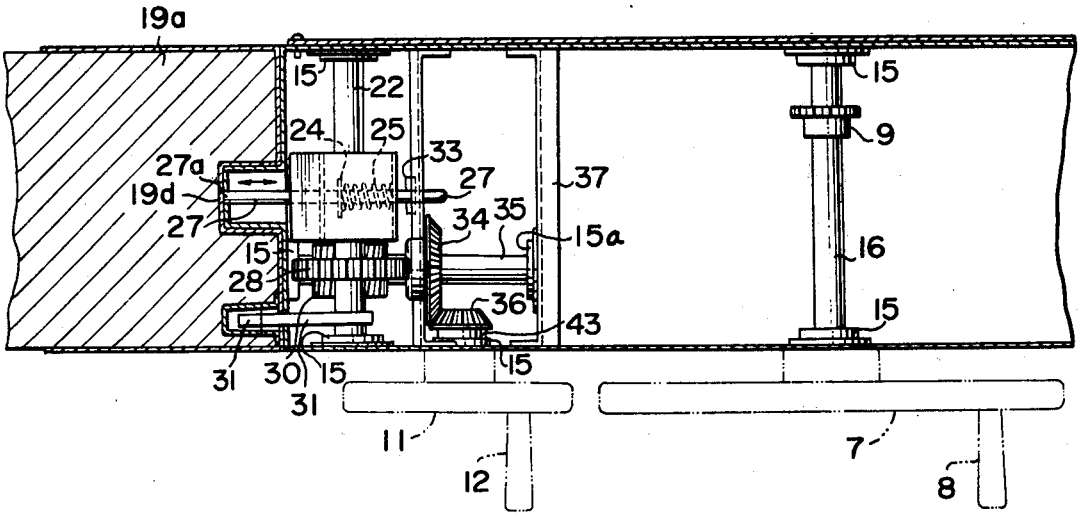
FIG. 4 shows partially in section, a side elevation of a handle driving section and locking/clamping means.
Figure 5:
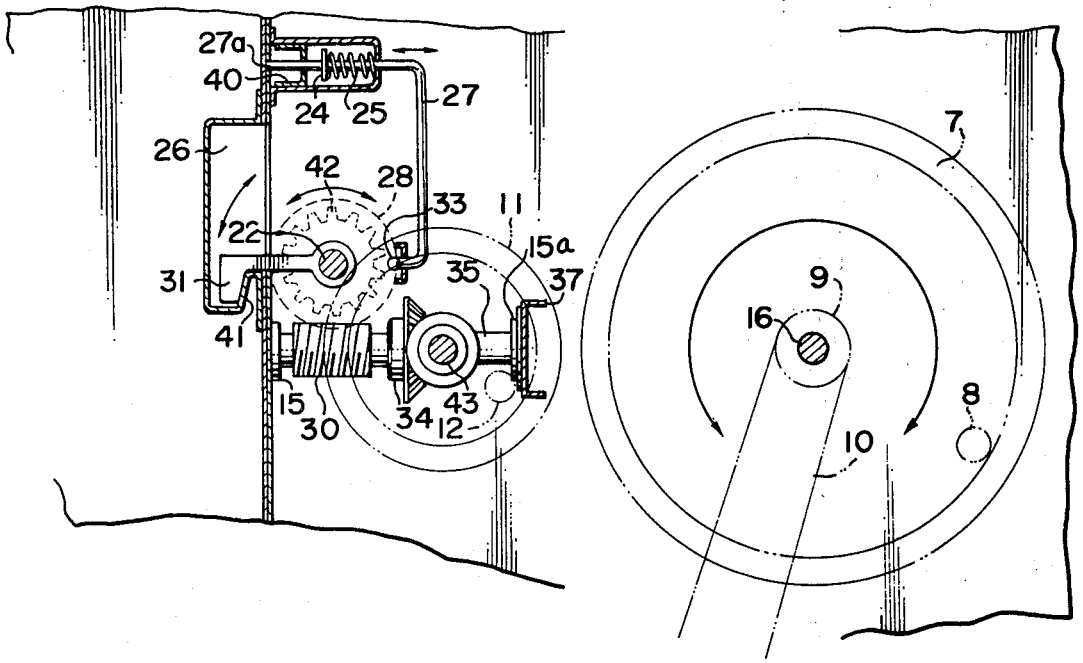
FIG. 5 is a partially sectioned side elevational view of the arrangement of FIG. 4.

FIGS. 4 and 5 show locking means provided at the contacting area of the door 1 and the flat wall 19*a* of the vault. A locking handle 11 and a handle bevel gear 36 are secured to a handle shaft 43. A bevel gear shaft 35 is supported at its both ends by bearings 15*a*, secured to a bearing fitting 37 and to a side panel of the door 1, respectively. The bevel gear shaft 35 carries a worm gear 30 and a bevel gear 34.

The bevel gear 34 is adapted for engagement with a bevel gear 36 on the handle shaft, thereby to transmit the rotary motion of the locking handle 11 to the worm gear 30 which in turn is engaged by a worm wheel 28 which is fixed to a stopper gear shaft 22. The stopper gear shaft 22 fixedly carries a stopper gear 42, as well as a metal locking piece 31, such that the locking metal piece 31 is rotated in the direction of the arrow in FIG. 5 around the stopper gear shaft 22, as the locking handle 11 is rotated in the direction of the arrow of FIG. 5.

As will be seen from FIGS. 4 and 5, the side panel of the door 1 is brought into contact with the flat wall 19*a* of the vault, in the closed state of the door. Then, the end 27*a* of a stopper shaft 27 which normally projects out because of a biasing force exerted by a spring 25, is depressed into the door 1, against the biasing force. Consequently, the spring 25 is compressed by a spring retainer 24 fixed to the stopper shaft 27, so as to bring the end 33 of the stopper shaft out of the groove between teeth at the periphery of the stopper gear 42.

Therefore, the locking handle 11 can freely be rotated in the closing state of the door, so as to put the locking metal piece into and out of engagement with a receptacle 41 embedded in the flat wall 19*a* of the vault.

When the door is kept opened and, accordingly, the side panel of the door 1 is kept away from the flat wall 19*a*, the end 27*a* of the stopper shaft 27 is allowed to project out of the side panel, due to the resilient force of the spring 25, and, at the same time, the stopper 33 is received in the groove between the peripheral teeth of the stopper gear 42. Consequently, the stopper gear shaft 22, as well as the locking handle 11, is locked against rotation.

Figure 6:
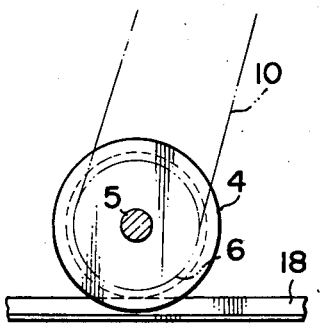
FIG. 6 is a side elevational view of a driving wheel section.
Figure 7:
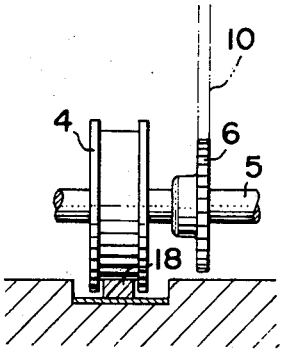
FIG. 7 is a partially sectioned front elevational view of the arrangement of FIG. 6.

FIGS. 6 and 7 are a side elevational view and a front elevational view, respectively, of an assembly including the wheel 4, wheel axle 5, driving shaft sprocket 6, power transmitting means 10 and the lower rail.

Figure 8:
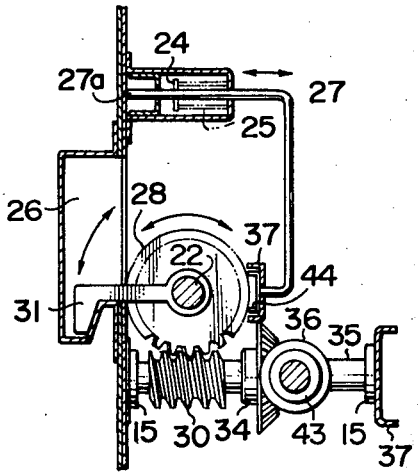
FIG. 8 is a partially sectioned side elevational view of another embodiment of the locking/clamping means.
Figure 9:
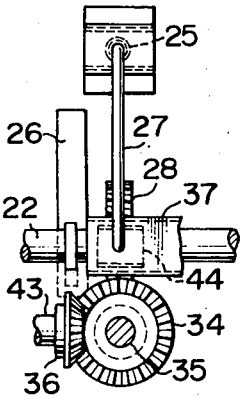
FIG. 9 is a rear view of the arrangement of FIG. 8.

FIGS. 8 and 9 show another embodiment for preventing the locking handle from being rotated. In this embodiment, the stopper gear 42 of FIG. 5 is replaced by the worm wheel 28. A further modification resides in that the end 44 of the stopper shaft 44 is U-shaped for getting in and out of the teeth groove of the worm wheel 28.

Figure 10:
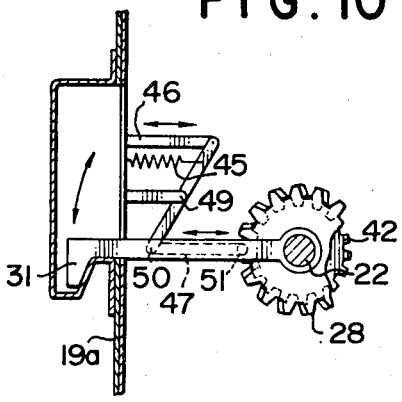
FIG. 10 is a partially sectioned side elevational view of still another embodiment of the locking/clamping means.
Figure 11:
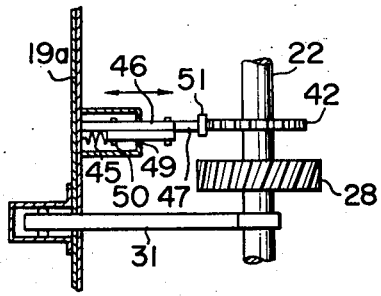
FIG. 11 is a partially sectioned plan view of the arrangement of FIG. 10.

FIGS. 10 and 11 show still another arrangement for preventing the locking handle 11 from being rotated. In this arrangement, a spring 45 is used in cooperation with a link mechanism, so as to bring the end 51 of the stopper into and out of engagement with peripheral teeth groove of the stopper gear 42. Therefore, in this arrangement, one end of a stopper link 46 is allowed to project out of the side panel of the door 1, due to the compression of the spring 45, so that the end 51 of the stopper link 47 is brought into engagement with the peripheral groove of the stopper gear 42, thereby to lock the stopper shaft 22 against rotation. The locking handle is therefore prevented from being rotated.

However, when the door is closed, the projecting end of the stopper link 46 is depressed into the door 1, being pushed by the wall 19*a* of the vault. Therefore, the link is rotated around a shaft 49, so as to pull the stopper link 47 leftward, thereby to disengage the end 51 of the stopper from the peripheral teeth groove of the stopper gear 42. The rotation of the stopper gear shaft 22 is therefore allowed which renders the handle 11 rotatable.

The sliding door of the invention is constructed as described above. In use, the operator extracts the grip 8 of the driving handle 7, and rotates the handle 7 counter-clockwise. Consequently, the wheel 4 is rotated counter clockwise, through the power transmitting means 10, so that the door 1 slides along the lower rail 18 leftward in the direction of the arrow. Similarly, the clockwise rotation of the driving handle 7 causes the rightward movement of the door 1.

By suitably selecting the ratio of the diameter of the handle shaft sprocket 9 to that of the wheel sprocket 6, and/or increasing multi-stage gears or sprockets between the sprockets 6 and 9*a*, desired increased or decreased sliding speed of the door can be obtained.

As the door 1 slides to bring the side panel thereof in contact with the flat wall 19*a* of the vault, the locking handle 11 comes to be rotated so as to put the locking metal piece 31 into a firm engagement with a recess or receptacle embedded in the wall 19*a*, thereby to tightly lock and clamp the door 1 to the flat wall 19*a* of the vault. This locking can be preserved, even when a force to keep the door 1 away from the flat wall 19*a* results from the misalignment of the level of the lower rail 18.

At the same time, in the closed state of the door 1, the projection 20*b* at the lateral side of the door 1 is firmly fitted into the recess of the groove 19*d* in the flat wall 19, while the hooked engaging portion 20*a* at the other lateral side of the door 1 is tightly fitted in the engaging portion 19*c* of the hook-shaped wall 19*b* of the vault, so that smoke and gases are prevented from getting into the vault, the smoke-proof structure is provided by the tight fittings at both lateral sides of the door 1.

Since the vault itself is lined with a refractory material, an excessive temperature rise in case of fire is fairly avoided.

The stopper mechanism conveniently prevents the rotation of the locking handle 11, when the door 1 is opened.

Thanks to the structural features as stated above, the sliding door of the invention promises the advantageous effects as follow.

(1) Thanks to the provision of the driving handle, a heavy sliding door can be operated smoothly with a reduced force. The optimum speed of sliding of the door can be obtained by suitably incorporating reduction gear or sprocket means in the power transmission means.

(2) The uneconomically large space required for a conventional hinged door can be dispensed with.

(3) The installation of the door is rendered much easier, as compared with conventional hinged doors. The installation cost can be reduced because a not so high precision is acceptable.

(4) Since the smoke-protecting structure against fire is much simplified, the cost of manufacture is considerably reduced as compared with the hinged doors.

(5) The operation is rendered much safer, due to the provision of means for preventing the rotation of the locking handle.

(6) The front surface of the door is always kept facing the customers, irrespective of whether the vault is opened for use or not, presenting a good appearance, which imparts an impression of dignity and safety of deposit to the customer, contributing greatly to win the customer's confidence.

The advantageous effects of the invention as stated above can equally be expected on facilities other than the vaults of banks, such as spaces for confidential documents in firms, incorporating the door of the invention.

A modification of the described embodiment, i.e. the second embodiment of the invention will be described hereinafter, with reference to FIGS. 12 through 23.

Referring at first to FIGS. 12 to 16, an entrance to a vault is constituted by an opening between a flat wall 109*a* and a hook-shaped wall 109*b* of the vault. The hook-shaped wall 109*b* is positioned inwardly of the flat wall 109*a*, by a distance equal to the thickness of a door 101. The end of the hook-shaped wall 109*b* forms an engaging portion 109*c*. A vertically extending groove 109*d* is formed on the end surface of the flat wall 109*a* for contact with the door 101. The arrangement is such that the groove 109*d* receives a projection 101*a* formed on one lateral side end of the door 101 when the door is closed. The other lateral side end of the door 101 constitutes an engaging portion 101*b* for engagement with an engaging portion 109*c* of the hook-shaped wall 109*b* of the vault, when the door is closed.

A wheel 111 is secured to the lower surface of the door 101 by means of an axle 113.

A lower rail 105 is laid to extend along the extension of the flat wall 109*a*, starting from the end of the wall 109*a*. The wheel 111 is adapted to roll on the rail, so as to move the door 101 along the rail.

At the top surface of the door 101, provided is a recess 101*c* on the center of which rotatably disposed is a guide roller 103 by means of a guide roller shaft 114.

At the top surface of the door 101, provided is a recess 101*c* on the center of which rotatably disposed is a guide roller 103 by means of a guide roller shaft 114.

An upper guide rail 102 is attached to the lower surface of a ceiling facing the top surface of the door 101. The upper guide rail 102 loosely accommodates guide rollers provided on the top surface of the door 101, so that the rollers may freely roll within the guide rail 102 to smoothen the sliding movement of the door 101. A handle 108 is secured to the surface of the door 101, at a position suitable for manual operation. A handle grip 107 is provided near the periphery of the handle 108, the grip turning up and down. A handle shaft 121 on which the handle 108 is mounted is rotatably secured to the inner surfaces of the door, through bearings 115*a*, and unitarily carries at its end opposite to the handle 108 a movable clutch 118 and a bevel gear 117 at its intermediate portion.

The handle shaft 121 is mounted to slide back and forth, with respect to the plane of the door, being supported by the bearings 115*a* and a bearing fitting member 138. The arrangement is such that the bevel gear 117 is brought into engagement with a bevel gear 116 as the handle 108 is withdrawn, and disengaged from the bevel gear 116 as the handle 108 is inserted. The retraction of the handle 108 also causes the engagement of the driving wheel 118 and a driven wheel 119 of the clutch with each other.

At both lower lateral sides of the door, the wheel axles 113 are supported by respective bearings 117. One of the wheel axles 113 carries a driving wheel sprocket 112. A clutch shaft 122 on the driven side is secured to the inside of the door, by means of a bearing 115, coaxially with the axis of a handle shaft 21. The shaft 122 carries at its end opposite to the bearing 115 the driven wheel 119 of the clutch, and, at its intermediate portion, a sprocket 120.

The driving and the driven wheels 118, 119 are disposed to confront each other, with a suitable gap left therebetween, and are adapted to be brought into and out of engagement with each other, by the back and forth movement of the handle shaft 121 due to an withdrawal and insertion of the handle 108.

Suitable power transmitting means which may be a chain, rope, belt or the like are provided around the handle shaft sprocket 120 and the driving wheel sprocket 112, for transmitting the rotational movement of the handle 108 to the wheel 111.

The other wheel having no power transmission means is allowed to idle freely, on its axle 113.

Figure 15:
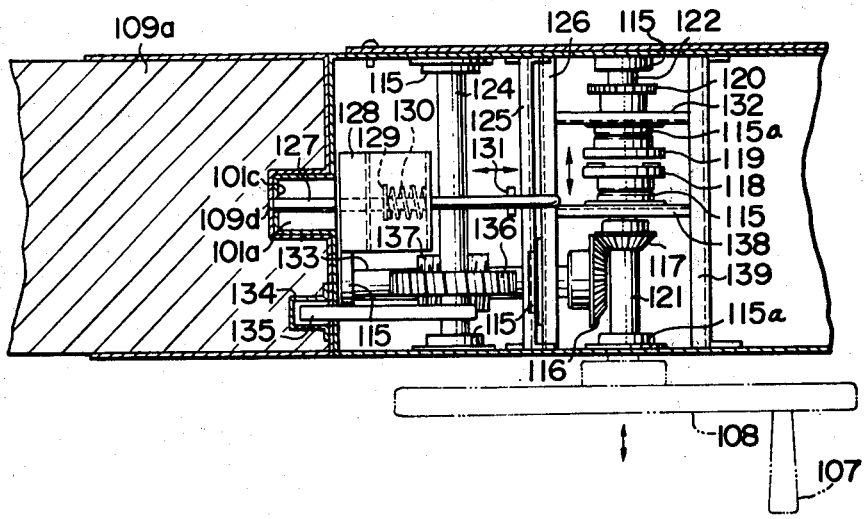
FIG. 15 is a partially sectioned plan view of driving means and locking/clamping means.
Figure 16:
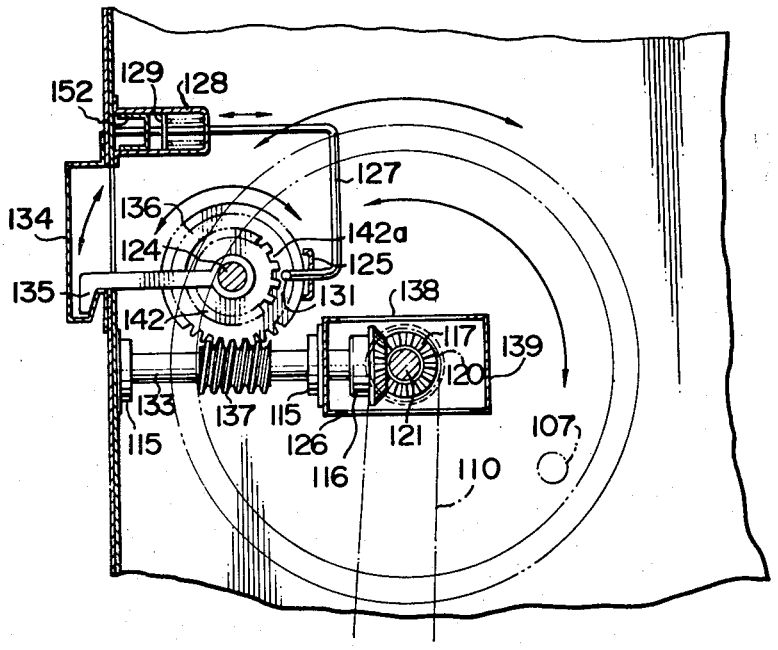
FIG. 16 is a partially sectioned side elevational view of the arrangement of FIG. 15.
Figure 17:
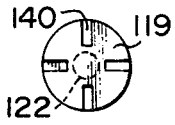
FIG. 17 is a front elevational view of a fixed side of a clutch.
Figure 18:
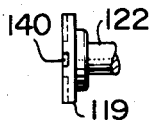
FIG. 18 is a side elevational view of the side of clutch as shown in FIG. 17.
Figure 19:
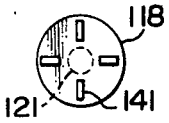
FIG. 19 is a front elevational view of the movable side of the clutch.
Figure 20:
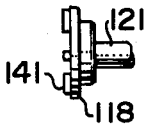
FIG. 20 is a side elevational view of the movable side of clutch of FIG. 19.

Referring now to FIGS. 15 and 16 showing a plan view and a side elevational view of a driving mechanism, as well as of a locking/clamping mechanism, the handle shaft 121 is supported by the bearing fitting member 138 and the front panel of the door, by respective bearings 115*a*. The handle shaft carries at its one end the driving wheel 118 of the clutch, and, at the other end, the handle 108. The bevel gear 117 is carried by the handle shaft 121, at an intermediate portion of the later, for engagement with the bevel gear 116 carried by one end of a worm gear shaft 133.

The worm gear shaft 133 is supported at its ends by a bearing 115*a* which is secured to the side panel of the door, and, at its intermediate portion, by another bearing secured to a bearing retainer 126.

The worm wheel shaft 124 is supported at its both ends by bearings 115*a* provided at the inside of the front and the rear panel of the door, respectively, and fixedly carries, at its intermediate portion, a worm wheel 136 for engagement with the worm gear 137.

A locking metal piece 135 has one end fixed to the worm wheel shaft 124, so as to be rotated in the direction of the arrow in FIG. 16, in accordance with the rotation of the shaft 124.

The projection 101*a* of the door has a through bore 101*c*. A stopper shaft 127 is slidably secured between the bore 101*c* and a stopper shaft attaching piece, by means of a stopper guide piece 128. The stopper shaft 127 is biased to position its end outside of the door, beyond the bore 101*c*, by means of a spring 130 acting on a spring retainer 129 on the stopper shaft 127.

Therefore, the opposite end 131 of the stopper shaft 127 is received by a groove 142*a* formed in the periphery of the stopper plate 142, to thereby lock the worm wheel 124 against the rotation. Thus, the handle 108 cannot be rotated in this state.

When the door has been closed the projection 101*a* on the door is received in the groove 109*d* in the flat wall 109*a* of the vault and, the end of the stopper shaft 127 which had projecting beyond the bore 101*c* is depressed inwardly of the door, so that the other end 131 of the stopper shaft comes out of the groove 142*a* of the stopper plate 142. The worm wheel 124 and, accordingly, the handle are allowed to rotate. When the handle is depressed into the door, the handle shaft 121 slides to disengage the bevel gear 117 from the bevel gear 116 and, at the same time, to bring the driving and the driven wheels 118, 119 of the clutch into engagement with each other. The sprocket 120 fixed to the clutch shaft 122 then rotates in accordance with the rotation of the handle.

Referring now to FIGS. 17 through 20 showing a front elevation and a side elevation of the driven and the driving wheels 119, 118 of the clutch, a plurality of grooves or recesses 140 are formed in the surface of the driven wheel 119 of the clutch, while the driving wheel 118 is provided with a corresponding number of projections 141 at positions confronting the grooves 140 of the driven wheel 119.

Figure 21:
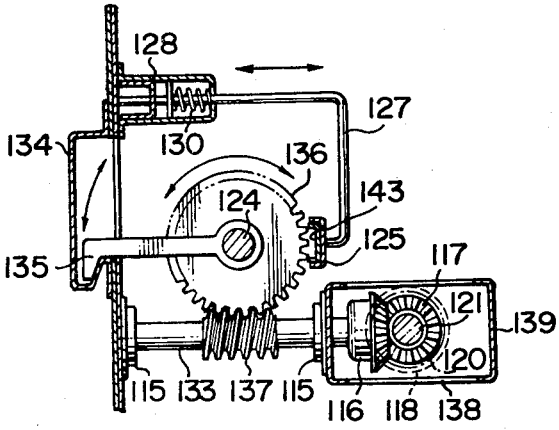
FIG. 21 is a partially sectioned side elevational view of another embodiment of the locking/clamping means.
Figure 22:
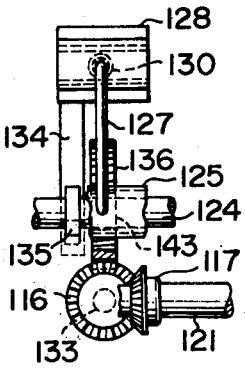
FIG. 22 is a rear elevational view of the means of FIG. 21.

FIGS. 21 and 22 are a side elevational view and a rear elevational view, respectively, of another embodiment of the mechanism for preventing the rotation of the handle in accordance with the invention. In this embodiment, the stopper plate 142 is replaced by the worm wheel 136, while the end 143 of the stopper shaft 127 is formed with a U-shaped cross-section, so that the end 143 may be put into and out of the peripheral groove of the worm wheel 136, thus presenting a partially simplified structure.

Figure 23:
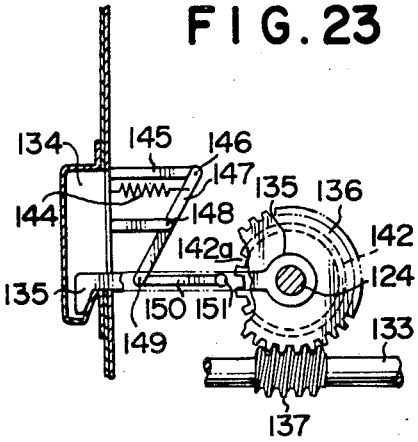
FIG. 23 is a partially sectioned side elevational view of still another embodiment of the locking/clamping means.
Figure 24:
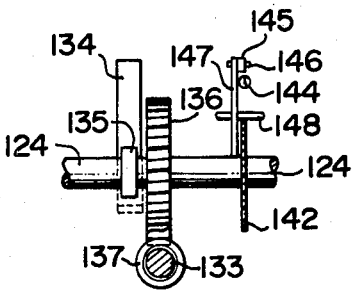
FIG. 24 is a rear elevational view of the means of FIG. 23.

FIGS. 23 and 24 show a side and a rear elevational views of still another embodiment of a mechanism for preventing the rotation of the handle, in accordance with the invention.

In the closed state of the door, the end of the stopper link 145 which projects out of the bore 101*c* of the projection 101*a* is depressed by the flat wall 109*a* of the vault, so as to rotate the stopper link 147 around a fulcrum shaft 148, stretching the spring 144. Consequently, a stopper link 150 connected to the link 147 through a pin 149 slides, so as to bring the stopper end 151 out of the peripheral groove 142*a* of the stopper plate 142 to, thereby allow the rotation of the worm wheel 124.

The second embodiment of the invention is constructed as detailed above. In operation, the handle 108 positioned for easy handling by the operator, is pressed toward the door, so as to slide the handle shaft 121 axially, thereby to disengage the bevel gear 117 from the bevel gear 116 and, simultaneously, to bring the driving and driven clutch wheels 118 and 119 into engagement.

This engagement of the clutch wheels provides a torque transmitting connection between the handle shaft 121 and the stationary side of the clutch 122, so that the rotation of the handle is transmitted to the handle shaft sprocket 120 fixed to the stationary side clutch shaft 122. The rotation is then transmitted to the sprocket 112 fixed to the wheel axle 113, through the power transmitting means 110 which may be a chain, rope, belt or the like, so as to cause the rotation of the wheel 111 which in turn effects the sliding movement of the door.

The force required for moving the door, i.e. the speed of the sliding of the door, can optimumly be selected, by suitably incorporating a multi-sprocket reduction means or gear means in the power transmission means 110.

As will be seen from the above statement, the locking and clamping means cannot be operated, whereas the handle operation for moving the door is allowed, when the handle is depressed into the door. As the door is moved leftward, by a counter-clockwise rotation of the handle 108 in the direction of arrow, the projection 101*a* of the door comes to be fitted into the groove 109*d* of the flat wall 109*a* of the vault. Under this circumstance, the end of the stopper shaft 127, which projects out, is pressed into the door, so that the other end 131 of the stopper shaft 127 is brought out of the peripheral groove 142*a* of the stopper plate 142, thereby allowing the worm wheel 124 to rotate.

The subsequent withdrawal of the handle 108 causes an axial sliding of the handle shaft 121, so that the driven and the driving wheels 119 and 118 are disengaged from each other. At the same time, the bevel gear 117 fixed to the handle shaft 121 comes into engagement with the bevel gear 116 carried by the end of the worm gear 133, so that the rotation of the handle is transmitted to the worm wheel shaft 124, through the handle shaft 121, bevel gear 117, bevel gear 116, worm gear shaft 133, worm gear 137, worm wheel 136 and the worm wheel shaft 124. Consequently, the hooked end of the locking piece fixed to the end of the worm wheel shaft is firmly received by the receptacle 134 at the lower portion of a mating locking piece 134 provided on the flat wall 109*a* of the vault to, thereby firmly lock and clamp the door onto the flat wall 109*a*.

For opening to door, the handle is withdrawn toward the operator, and is then rotated clockwisely, so that the locking metal piece 135 is rotated along with the worm wheel shaft 124 rightwardly in the direction of arrow, thereby to release the lock. A subsequent depression and the rightward rotation of the handle in the direction of arrow causes the rotation of the wheel 111, through the driving and the driven sides 118 and 119 of the clutch, clutch shaft 122, handle shaft sprocket 120, power transmission means 110, sprocket 112 and the wheel axle 113, so as to move the door righward, in the direction of the arrow, along the lower rail 105.

In the opened state of the door, the end of the stopper shaft 127 projects outwardly from the projection 101*a*, beyond the bore 101*c*, by the biasing force exerted by the spring 130, so that the other end 131 of the shaft 127 is positioned in the peripheral groove 142*a* of the stopper plate 142, thereby locking the worm wheel shaft 124 and, accordingly, the handle against rotation.

When the door is in the closed state, the projection 101*a* of the door is closely fitted into the groove 109*d* of the flat wall 109 of the vault, while the engaging portion of the other end of the door is kept in a tight engagement with the engaging portion 109*c* of the hook-shaped wall of the vault, this forming a smoke or gas proof structure for preventing the invasion of the vault by the smoke or gases in case of fire. The door is suitably lined with a refractory material to prevent the temperature in the vault from becoming excessively high, even in case of fire.

Thanks to the structural features as stated above, the sliding door of this embodiment ensures the following advantageous effects.

(1) The opening and closing operation, as well as the locking of the door can be simply effected by a single handle.

(2) The rotation of the handle causes only the movement of the door but not the operation of the locking and clamping mechanism, when the door is in the opened state. To the contrary, when the door is kept closed, the rotation of the handle causes the actuation of the locking and clamping means but not the movement of the door.

(3) The operation is rendered much safer, since the locking and clamping mechanism is locked against operation to prevent the rotation of the handle.

(4) Since the single handle is designed to perform the double functions of moving the door and the operation of the locking and clamping mechanism, the whole structure is much simplified as compared with sliding doors having separate handles for respective functions.

Having described the invention with specific reference to preferred embodiments, it is to be pointed out here that various changes and modifications may be imparted thereto without substantially departing from the scope of the invention which is delimited solely by the appended claims.

What is claimed is:

1. A door adapted to be moved on a rail laid along a wall to close an opening in the wall, comprising:

a door body having a plurality of wheels, each of said wheels having an axle for mounting said wheels on said door body;

a manually rotatable means having a first shaft rotatably attached to the front side wall of the door body, said rotatable means being slidably movable back and forth along the axis of said shaft;

a rotary driving member of a predetermined diameter coaxially carried by said shaft;

a rotary driven member carried by one of said axles and having a diameter larger than that of said driving member;

an endless power transmission member connected between the driving and the driven members;

clutch means for transmitting the rotation of said first shaft to said driving member when the clutch means are engaged;

locking means having a second shaft operably coupled to said first shaft wherein the rotational movement of said first shaft is transmitted to said second shaft when said clutch means are disengaged, said locking means locking said door in the closed position when said manually rotatable means is operated;

gear means coupling said first and second shafts;

stopper means having detecting means partially extending out of the side end of said door body and positioned for detecting a wall contact, and engagement means positively locking said locking means in a fixed conditon when said detecting means are not actuated.

2. A door as claimed in claim 1, wherein said stopper means comprise a toothed wheel formed coaxially with said locking means on said second shaft, said detecting means comprising a projecting rod extending out of the side end of the door, said rod actuating said engagement means for engagement with said toothed wheel.

3. A door as claimed in claim 2, wherein said engagement means comprise a detent member having a rod pin mounted on a connecting member coupling said detecting means and said detent member.

4. A door as claimed in claim 2, wherein said engagement means comprise an U-shaped detent member having a rod pin mounted on a connecting member coupling said detecting means and said detent member.

5. A door as claimed in claim 2, wherein said detecting means includes spring means for biasing said projected rod.

6. A door as claimed in claim 2, wherein said clutch means comprise a pair of disc plates mounted on abutting portions of said manually rotatable means.

7. A door as claimed in claim 6, wherein said detecting means include spring means for biasing said projected rod.

* * * * *